US006164936A

United States Patent [19]

Djelouah

[11] Patent Number: 6,164,936

[45] Date of Patent: Dec. 26, 2000

[54] VERTICAL RECIPROCATING PUMP HAVING EASILY INSTALLED PISTON WITH FLAP VALVES

[75] Inventor: Salah Djelouah, Saint-Denis-de-l'Hotel, France

[73] Assignee: Sorelec, France

[21] Appl. No.: 08/945,447

[22] PCT Filed: May 3, 1996

[86] PCT No.: PCT/FR96/00674

§ 371 Date: Feb. 13, 1998

§ 102(e) Date: Feb. 13, 1998

[87] PCT Pub. No.: WO96/35055

PCT Pub. Date: Nov. 7, 1996

[30] Foreign Application Priority Data

May 5, 1995 [FR] France ..... 95 05415
Sep. 19, 1995 [FR] France ..... 95 10968

[51] Int. Cl.[7] ..... F04B 39/10; F16K 15/00

[52] U.S. Cl. ..... 417/550; 417/555.2; 137/512.1

[58] Field of Search ..... 417/550, 555.1, 417/555.2, 552; 137/512.1, 513, 854; 91/422; 92/255

[56] References Cited

U.S. PATENT DOCUMENTS

| | | | |
|---|---|---|---|
| 25,367 | 9/1859 | Poole | 417/550 |
| 274,308 | 3/1883 | George | 417/550 |
| 378,848 | 2/1888 | Normand | 417/550 |
| 949,423 | 2/1910 | Garber | 417/250 |
| 1,175,543 | 3/1916 | Molinder | 417/552 |
| 1,362,838 | 12/1920 | Brandt | 417/549 |
| 3,752,604 | 8/1973 | Dorn | 417/511 |
| 4,951,706 | 8/1990 | Kardos | 137/512.1 |
| 5,285,847 | 2/1994 | Halper et al. | 417/550 |

FOREIGN PATENT DOCUMENTS

| | | | |
|---|---|---|---|
| 1515233 | 1/1968 | France . | |
| 2 518 181 | 6/1983 | France . | |
| 2634253 | 1/1990 | France . | |
| 24 38 796 A1 | 2/1976 | Germany . | |
| 136757 | 7/1979 | Germany | 417/555.1 |
| 2148405 | 5/1985 | United Kingdom | 417/550 |
| WO 88/04365 | 6/1988 | WIPO . | |

*Primary Examiner*—Charles G. Freay
*Assistant Examiner*—Michael K. Gray
*Attorney, Agent, or Firm*—Baker & Daniels

[57] ABSTRACT

A vertically reciprocating pump is described, characterized by a piston which has a support including a hub extending downwards and supporting reinforcement legs, the hub having a rod to which it is translatably coupled passing therethrough, and by a valve overlying the support, which seals the piston under the weight of the column of liquid above it or allows the passage of liquid when the piston moves down the water column in the drainage pipe.

11 Claims, 9 Drawing Sheets

VERTICAL RECIPROCATING PUMP HAVING EASILY INSTALLED PISTON WITH FLAP VALVES

The present invention relates to a vertical reciprocating pump for raising fluids which are present in the ground.

A vertical reciprocating pump of this type is already known, in particular as described in document OAPI 06 221 of Mar. 23, 1979. Pumps of this type are designed to pump fluids which are present in the ground, such as underground waters, petroleum etc.

The known vertical reciprocating pumps, which are designed to pump water, are operated manually. According to the depth of the fluid table they consist either of a rod or a vertical set of rods which support one or a plurality of flap-valve pistons.

The known pistons generally consist of a cylinder of a specific length, which is provided on its periphery along one of its edges, and in particular the upper edge, with a gasket which slides in the raising tube.

This part of the cylinder is engaged in a sliding manner on a body, which for example consists of ribs and ends at its base in a flap valve. When the cylinder of the piston descends on the flap valve, the piston is sealed. In the opposite case the fluid can pass through the piston. These two different positions between the cylinder and the flap valve correspond respectively to the movement of descent of the piston in the water column contained in the cylinder of the pump body or raising tube, and to the movement of raising of the fluid column above the piston.

A multiple piston pumping device is also known (FR-88 09 575) in which the piston consists of a cylinder, the base of which has a so-called alveolar structure. This cylinder is fitted onto the rod which controls the reciprocating motion. Above the alveolar base there is provided a lifting flap valve which is maintained supported against the alveolar structure by a tubular component. This tubular component passes through the interior of the cylinder and is supported against a stop which is integral with the rod. Below the piston, i.e. below the alveolar base of the cylinder, a nut and counternut are provided to lock the assembly.

The cylinders of the known pistons have the disadvantage that they rub substantially on the inner surface of the raising column, and this friction increases when the raising tube sustains deformations as a result of movements of the ground, since the piston is then forced to follow this deformed path.

The gasket along the upper edge of the cylinder, which is applied against the inner wall of the raising tube or the cylinder, itself increases this friction as a result of the pressure exerted by the fluid column against the gasket and the cylinder.

The fluids which are pumped are often loaded, and eventually particles are deposited on the seats of the flap valves of the piston. The pistons thus lose their sealing, which decreases the flow of fluid pumped. Consequently the pistons must be replaced frequently, which increases the operating cost of the pump.

Since the flap valve is a wear part, it becomes worn and may need to be replaced. In this case, the piston assembly must be dismantled in order to access the flap valve, remove the flap valve to be changed, and put into place the new flap valve. For this purpose it is necessary to remove the piston completely from the rod in order to be able to fit the new flap valve.

This constitutes a relatively lengthy operation for replacement of a very simple part.

In addition, since the flap valve is located in the cylinder, when the pump is stopped the solid particles in suspension in the water which are continued in the piston are gradually deposited on the base. Since the piston is not perfectly sealed, the water leaks out and carries with it the solid particles in suspension which can be deposited between the edge of the diaphragm and the inner wall of the piston, during the interval necessary in order to allow the flap valve to be raised without rubbing against the piston.

This situation is disadvantageous for pistons which are not immersed; if for any reason the pump is stopped for a given time, i.e. for a few hours or a few days, the solid particles then block the valve, and experience has shown that in this case it is necessary to remove all the pistons from the water in order to dismantle them and release the diaphragms which are thus stuck.

This constitutes substantial work, and therefore a serious and inevitable disadvantage, since the pump is necessarily stopped from time to time, even if only in the case of pumps which are operated manually or by a electric motor which is powered by solar batteries, without a buffer battery with a sufficient capacity for continuous operation.

The object of the present invention is to eliminate these disadvantages by creating a reliable reciprocating pump with a simple structure, which makes it possible to pump fluids efficiently even from very deep fluid tables, and has a very regular flow rate even after a prolonged period of use, and which, when necessary, can be maintained or replaced simply, or which prevents the flap valve of the piston or pistons which is/are above the level of the water when the pump is stopped from being blocked by any particles in suspension in the water.

For this purpose, the invention relates to a vertical reciprocating pump which corresponds to the above-described type.

The pistons are easily fitted on/removed from the rod or the assembly of components which constitute a set of rods of a pump for a substantial depth.

The simplicity of production, associated with the small number of simple parts which constitute a piston, permit assembly and above all installation of the pistons by unqualified workers, in installation conditions which are often rudimentary. The same applies to maintenance interventions.

Additionally, the structure of the piston prevents virtually all depositing of solid particles and any blockage of the flap valve of the piston or of the piston itself in its tube, since the piston is rinsed in operation and at the end of a pumping stage.

The specific shape of the piston has the advantage that it keeps to a minimum the contact with the inner suface of the raising tube.

In the simplest case the flap valve consists of a raisable diaphragm which rests on the support in order to support the water column, in accordance with a feature which is advantageous for operation.

The diaphragm which forms the flap valve is cut at its outer edge as far as the aperture which is used for passage of the rod, such as to be able to engage the diaphragm on the rod without having to thread it onto the latter.

The diaphragm which is in the form of a split disc is very easily positioned above the support, simply by unscrewing one of the two nuts which maintain the support. This operation is carried out very quickly, and it is not at all necessary to remove the support of the rod, i.e. to carry out problematic unscrewing operations.

The diaphragm can also consist of a plurality of segments which partially overlap. An embodiment of this type has the advantage of simplicity of installation and removal; it constitutes a flexible shape which allows the different segments to be raised partially or relative to one another.

According to the conditions of use and operation of the pump, the piston has dimensions which are more or less close to the inner cross-section of the raising tube.

In order to make the pump function lightly and reduce the power required to make it operate, greater play is left than if the pump were operated by a motor supplied by mains electrical energy, rather than by a relatively limited energy source.

Since in addition there is at the most only peripheral linear contact between the piston and the inner surface of the tube, even when the raising tube is deformed as a result of movements of the ground, this virtually does not impede at all the reciprocating motion of the piston, and in particular does not increase the friction forces between the piston and the inner surface of the tube.

In the case of a pump used for a very deep water table, a flap valve in the form of a diaphragm would not resist the water column, and in this case it consists of a rigid material, and more specifically the support comprises legs in the form of vertical triangles which are attached by one of their sides to the upper and auxiliary hub, and are joined around the entire height of the support in order to form at the top part of the latter branches for support and attachment of the flap valve.

The flap valve consists of segments of a disc which are each connected by one of the radial sides to the upper radial part of a leg, and the other radial side of the flap valve is supported in the sealing position, on the upper radial part of the following leg.

This embodiment has the advantage that it permits particularly efficient pumping of a very high water column without detracting from the ease of descent or strength of the piston.

In addition, a film of fluid is formed between the wall of the tube and the piston or pistons, by this means virtually reducing the friction to zero, particularly since there is no gasket between the piston and the wall which would scrape away this fluid film.

The present invention is described hereinafter in greater detail by means of the attached drawings in which.

Figure 1:
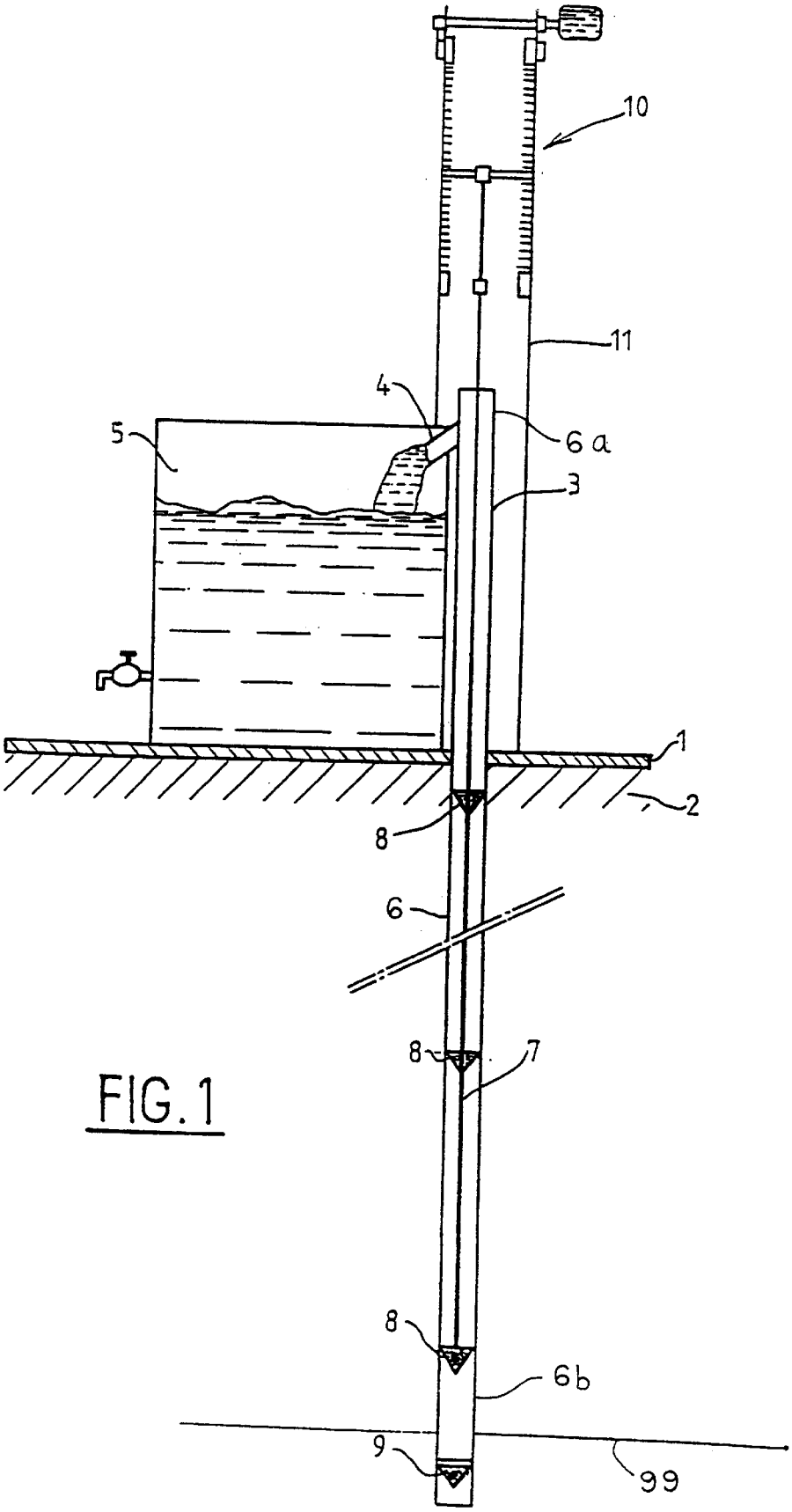
FIG. 1 is a schematic vertical cross-section of a vertical reciprocating pump.

According to FIG. 1, the vertical reciprocating pump according to the invention consists of a base 1 which is supported on the ground 2. A vertical well 3 is integral with the base 1; it comprises a fluid outlet spout 4 which discharges into a tank 5. This well tube 3 is prolonged at its lower end by a raising tube 6, including upper end 6*a* and lower end 6*b*. This tube 6 accomodates a control rod 7 which is provided with one or a plurality of pistons 8 which are described hereinafter. The lower end 66 of the raising tube 6 is provided with a base flap valve 9.

The rod 7, which can also be a set of rods, i.e. an assembly of rods which are attached one after another, according to the depth of the water table 99 from which pumping is being carried out, is controlled in reciprocating motion by a mechanism 10 which is shown only very schematically. This mechanism 10 is supported by a frame 11. The mechanism 10 can be operated either manually, or by an animal, or by a thermal or electric motor, and in the latter case an autonomous electric supply unit can be used, for example solar-powered batteries.

The reciprocating vertical motion of the rod 7 and of the pistons 8 firstly raises the fluid column which is supported on the pistons 8, and discharges a specific quantity of fluid into the tank 5; the rod 7 then lowers the pistons 8 inside the fluid column which is contained in the raising tube 6 and is retained by the base flap valve 9. When they reach the lower end of travel, the pistons 8 are raised by the rod 7, and thus raise the fluid column above each piston. At the same time, the piston above the base flap valve 9 creates a depression above the latter. This depression draws in fluid through the base flap valve 9 into the tube 6. The cycle continues thus.

Figure 2:
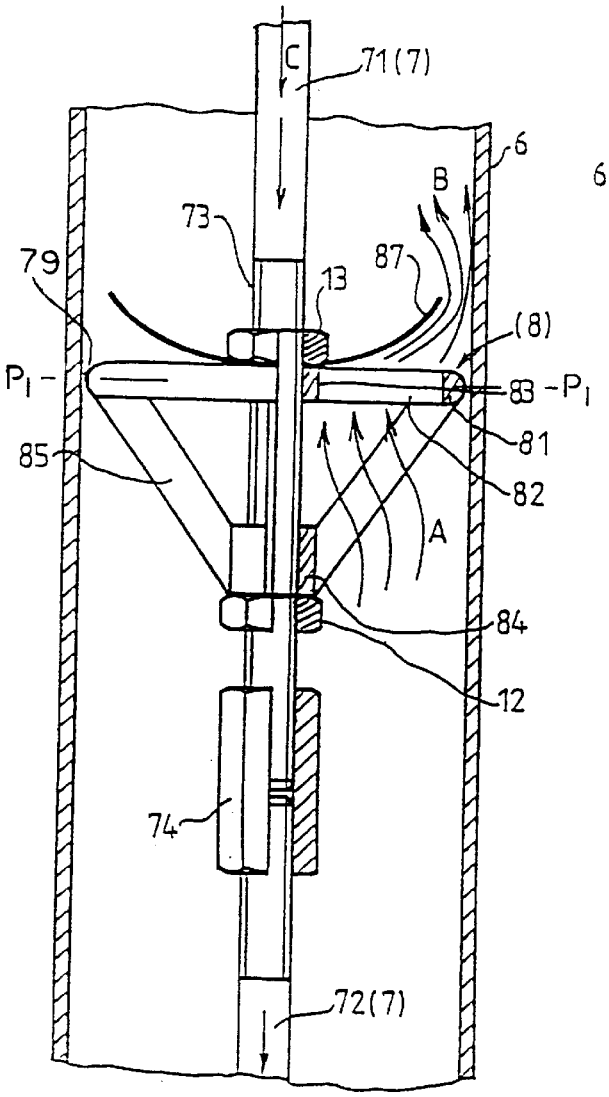
FIG. 2 is a partial schematic vertical cross-section of a piston descending its rod.
Figure 3:
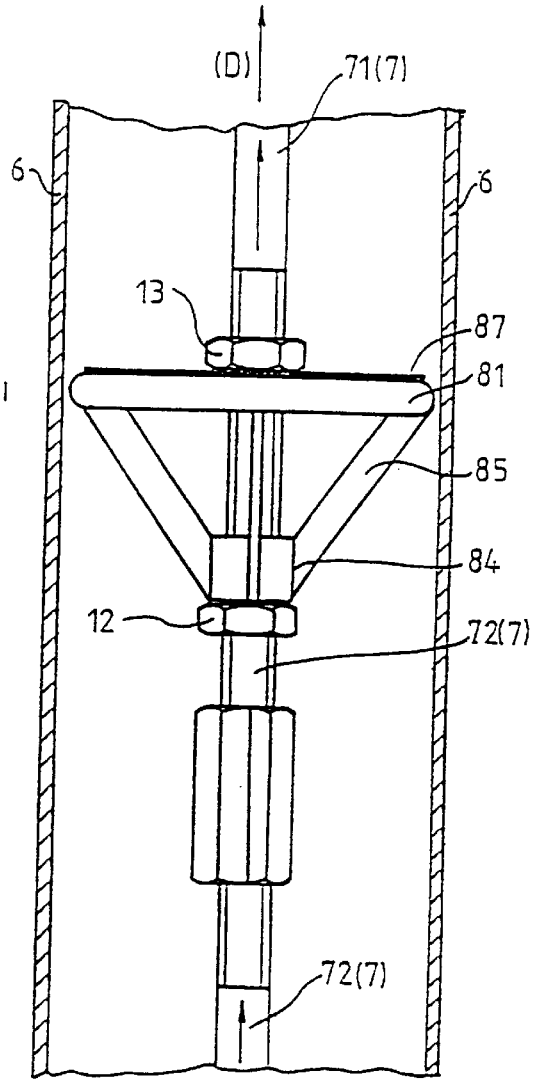
FIG. 3 is a schematic vertical cross-section of the piston ascending the rod.

FIGS. 2 and 3 show the structure of a first embodiment of a piston 8, i.e. firstly in FIG. 2 the position of descent of a piston 8 which is driven by its rod 7, and then raising of the piston in FIG. 3.

In these figures the same reference numerals as in FIG. 1 are used to designate the same components.

FIG. 2 is a partial axial cross-section of the raising tube 6, showing the rod 7 or set of rods, consisting of a rod part 71 which is connected to a rod part 72 by means of a threaded sleeve 74; the lower end 73 of the rod 71 is threaded beyond the extent which is necessary simply for screwing the sleeve 74 in order to accomodate the piston 8. This piston 8, which is attached between a lower nut 12 and an upper nut 13, consists of a support in the form of a disc which comprises an outer ring 81 which is connected by radii 82 to an upper hub 83, through which there passes the rod 71 (or its threaded part 73), and it comprises a lower hub 84 through which the rod 71 also passes; this lower hub 84 holds the support by means of legs 85 which are connected to the ring 81.

Above the support, the piston 8 has a flap valve, which in this case consists of a flexible diaphragm 87.

The radial form of the support, both at the legs 85 and at the radii 82, permits passage of the (raised) fluid in the direction of the arrows A, B, when the piston descends in the fluid column in the raising tube 6, as shown by the arrow C.

This descent of the piston 8 raises the diaphragm 87.

FIG. 3 shows the movement of raising the rod 7 (or rod components 71, 72 in the case of a set of rods), which is identical to that in FIG. 2, according to raising movement which is indicated by the arrow D.

During this raising movement, the fluid column holds the flap valve 87 against the support, and in particular the upper part of the support of the piston 8, i.e. the ring 81, the radii 82 and the upper hub 83, thus closing the piston 8 in a sealed manner; this permits raising of the fluid column.

It should be noted that as already stated, the piston 8 is locked on the rod 7 by the nuts 12, 13 which also retain the flap valve 87.

During the raising movement, the legs 85 transmit some of the force applied to the outer part of the support, towards the lower hub 84.

According to FIGS. 2 and 3, the outer ring 81 of the support has a beveled or rounded edge, thus reducing to a minimum the contact between the piston 8 and the inner surface of the raising tube 6. This linear contact describes a circle, lies in a plane $P_1$-$P_1$, which plan $P_1$-$P_1$ includes a plurality of contact points 79 between piston 8 and raising tube 6 and does not follow a cylindrical surface, which permits absorption of all the deviations or differences of alignment, for example in curvature, between the rod 7 and the raising tube 6, thus reducing to a minimum the friction forces which oppose the raising movements.

In addition, the flap valve 87 is raised flexibly from the support 81, 82, 83, and allows the fluid to rinse the support, thus preventing any depositing of solid particles which would detract from sealing of the piston for the raising movement.

Even if particles in suspension are deposited near the gap between the edge of the ring 81 and the inner surface of the raising tube 6 during a prolonged stoppage of the pump, when the raising or lowering movement is resumed the adhesion of the particles will be eliminated, since movement is transmitted directly by the rod or set of rods 7, 71, 72 to the piston 8.

The cross-sections of the raising tube 6 and of the piston 8 are circular, although this shape is not restrictive, and does not exclude a polygonal shape such as a hexagon or square etc.

Figure 4:
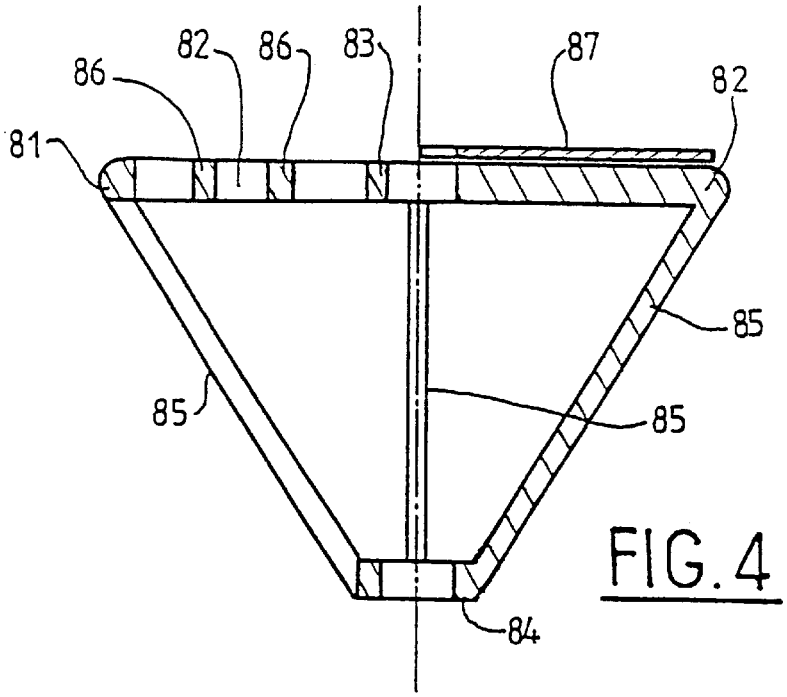
FIG. 4 is an axial cross-sectional view of the piston support according to line IV—IV in FIG. 5.
Figure 5:
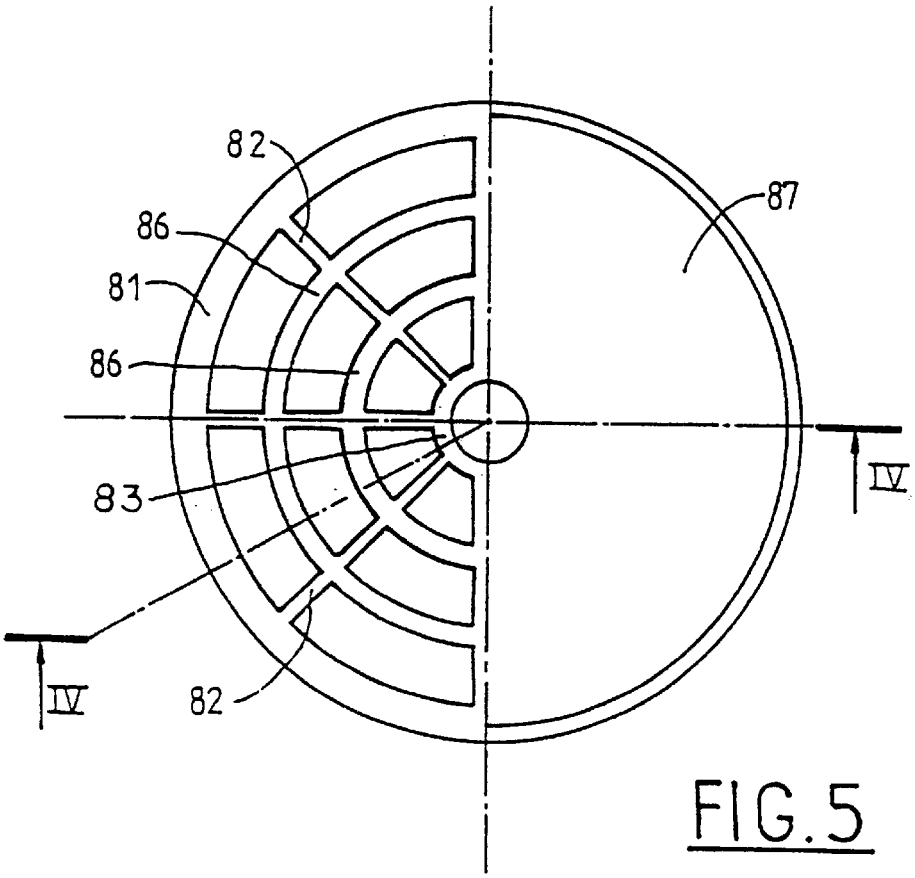
FIG. 5 is a view from above of the piston support.
Figure 6:
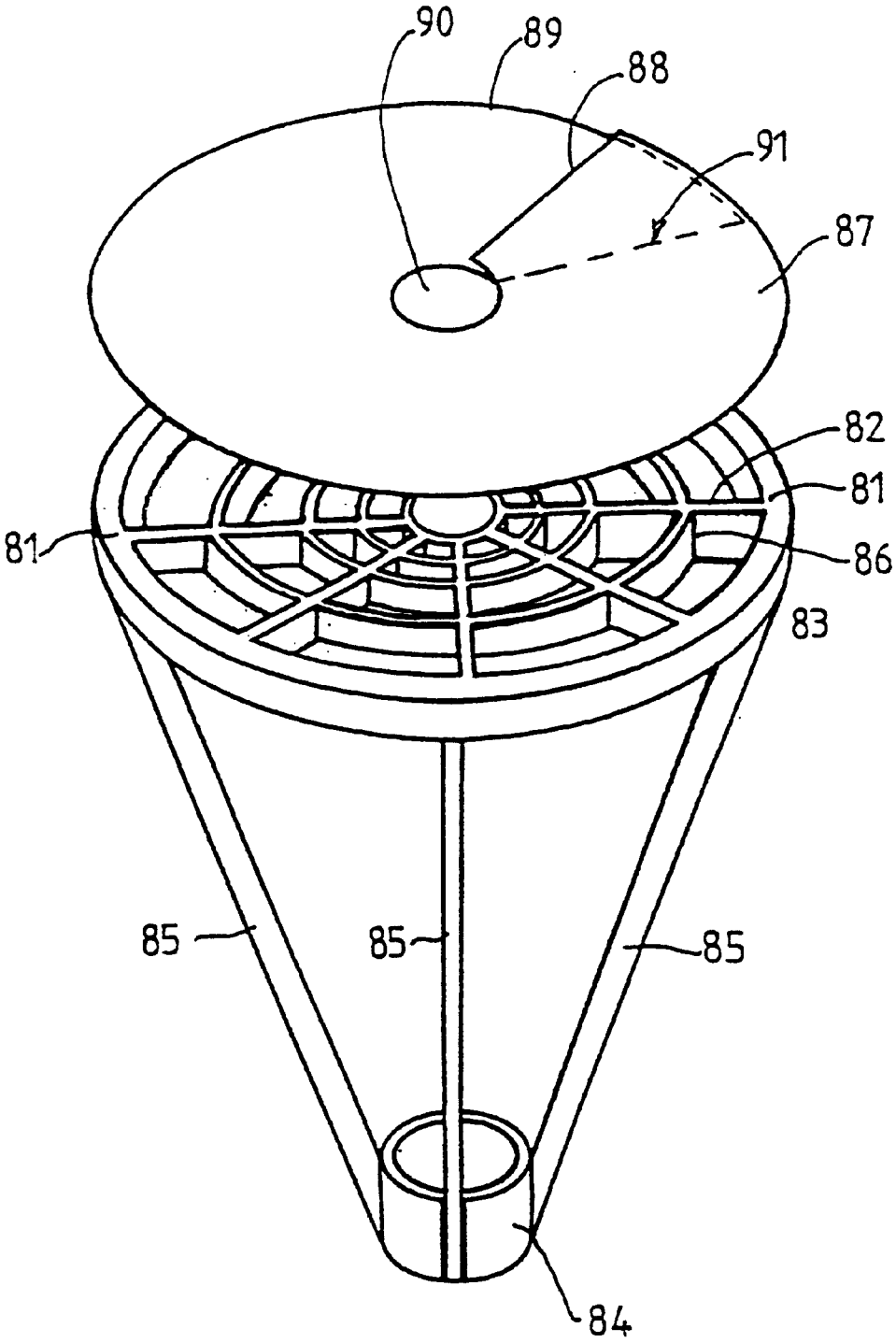
FIG. 6 is an exploded view of the piston.

FIGS. 4, 5, 6 show in greater detail the structure of a piston as described above. FIG. 4 shows in cross-section the support with its outer ring 81, a cross-section of a branch 82, the flange of the upper hub 83, one of legs in cross-section and another of legs 85 not in cross-section, the intermediate rings 86 and the flange of the lower hub 84. Half the diaphragm 87 is shown in cross-section in FIG. 4 and in top elevational view in FIG. 5. The other half of diaphragm 87 is not shown in FIGS. 4 and 5.

FIG. 5, which is a top elevational view of the apparatus illustrated in FIG. 4, shows half the diaphragm 87 and the different parts of the support, in particular the radii 82, the rings 81, 86 and the upper hub 83 having between one another the gaps for passage of the fluid to be pumped.

The exploded view in FIG. 6 shows these different parts, i.e. the flap valve in the form of a diaphragm 87, the support, and its component parts 81, 82, 83, 84, 85, 86.

The piston support is a part which is produced for example in a single piece, for example from molded plastics material. The flap valve 87 is preferably made of a flexible material such as synthetic rubber or a plastics material.

The dimensions of the flap valve are such that it covers the apertures of the support and reaches close to the inner surface of the raising tube, with a gap which is at least sufficient to leave a film of fluid along the wall of the tube.

Although the flap valve 87 can be a part in the form of a disc which fits onto the rod 7, according to FIG. 6 it is advantageously split, i.e. the disc which forms the flap valve 87 is cut along a line 88. This cutting line can be the joining line of the two edges of cutting of the disc. This cutting line 88 extends from the outer edge 89 to the aperture 90 in the middle of the flap valve 87 which accommodates the rod 71 (7).

The edges of the cutting line 88 can also overlap as shown by the broken line 91. This line is in fact the edge of a part of the disc which is disposed beneath the upper edge, such that the two edges of the disc overlap on the angle segment which is between the lines 88 and 91.

This embodiment of the flap valve permits simple replacement of a worn or damaged flap valve, without having to dismantle the actual support.

Figure 7:
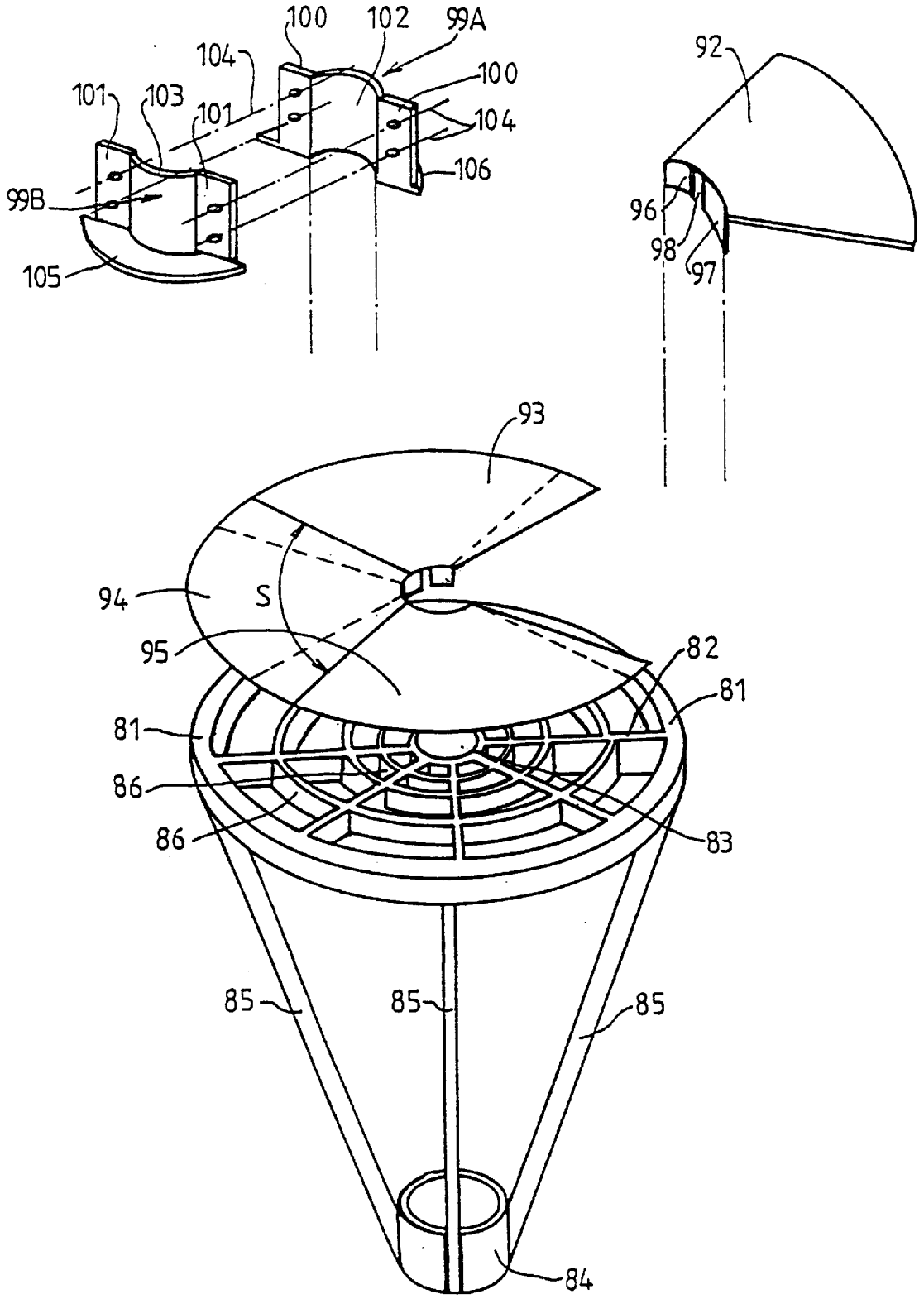
FIG. 7 is a perspective view of another embodiment of a piston.

FIG. 7 is an exploded view of a variant embodiment of a piston, which is distinguished from the previous pistons by the specific form of the flap valve and the method of attachment of the latter.

All the parts which are identical to those of the preceding embodiments have the same reference numerals.

This piston variant is distinguished by the form of the flap valve which consists of four segments 92, 93, 94, 95. The segment 92 is shown separately from the other segments, which are shown in the assembled position. These segments can have the same shapes and the same dimensions, and can overlap in the manner of fish scales. As shown in the variant in FIG. 7, it is also possible firstly to place two segments 93 and 95 in a diametrically opposed position on the support 81–86, then to place the two segments 92 and 94 above the segments 93 and 95, thus creating slight overlapping which is represented by the broken lines. In the case of a flap valve of this type, when the piston descends into the water, the upper segments 92 and 94 are raised before the segments 93 and 95. The segments 92 cover the upper ¼ disc angle such as to be able to overlap as shown.

These segments are also extended by two curved lugs or hooks 96, 97 at the aperture. These two lugs 96, 97 have a slit 98 between them.

The lugs 96, 97 and the slit 98 make it possible to place each segment, for example segment 92, such that it straddles a radial branch 82, and is disposed between the inner ring 83 and the directly adjacent intermediate ring 86. In the example shown, the first intermediate ring is very close to the upper hub 83, and the distance between these two rings leaves space for the lugs 96, 97.

When the segments of the flap valve 92–95 are thus positioned on the support which is previously attached to the rod 7 (not shown), the upper attachment unit is installed, consisting of two halves 99A, 99B which each end in assembly lugs 100, 101. These two parts 99A, 99B have a threaded inner surface, such that the two parts are joined to constitute a single continuous thread. These parts are assembled for example by screws not shown, as indicated by the broken lines 104.

At their base, the parts 99A, 99B are extended by a half-flange 105, 106; when the part is assembled the latter are complemented in order to form a flange which supports the segments 92–95 against the support of the piston 8 which has previously been put into place on the rod.

In fact after the segments 92–95 have been put into place, the two parts 99A, 99B of the upper attachment unit 99 are assembled on the threaded part 73 (FIGS. 2 and 3) of the rod 71, 7, then this unit 99A, 99B is screwed in order to clamp the segments 92–95.

In order to ensure that this nut is locked such that it is not unscrewed by the effect of vibrations, the two parts 99A, 99B can be clamped against one another, if there is still a given amount of play between them, in order to lock the threads of the surfaces 102, 103 in the thread of the threaded part 71, and to prevent unscrewing.

According to a variant which is not shown, the flap valve is in the shape of a tulip which is attached close to the outer edge of the outer ring 81; the flap valve then opens around the rod which is optionally provided with a seal to form a seat for the edge of the flap valve. In this variant, the edges of the "petals" of the flap valve on the opening side can be joined by a ring which is engaged on the rod.

According to another variant, the flap valve in the shape of a tulip consists of a single diaphragm with a frusto-conical shape which is attached by its outer edge, the inner edge which borders the aperture optionally being provided with a ring which surrounds the rod; this diaphragm can also be provided with a part which forms the shutting seat against which the edge of the aperture of the flap valve is supported.

Figure 8:
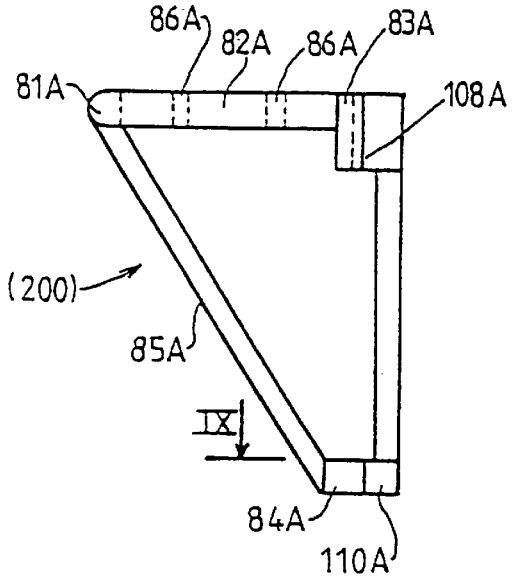
FIG. 8 is a side view of a support shell according to another embodiment of the invention.
Figure 10:
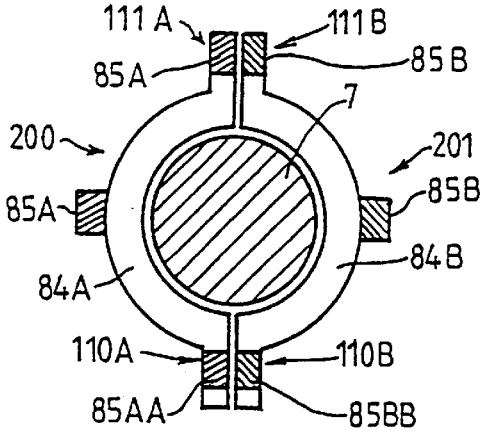
FIG. 10 is a partial cross-section according to IX, showing the full support assembled on a rod 7.
Figure 9:
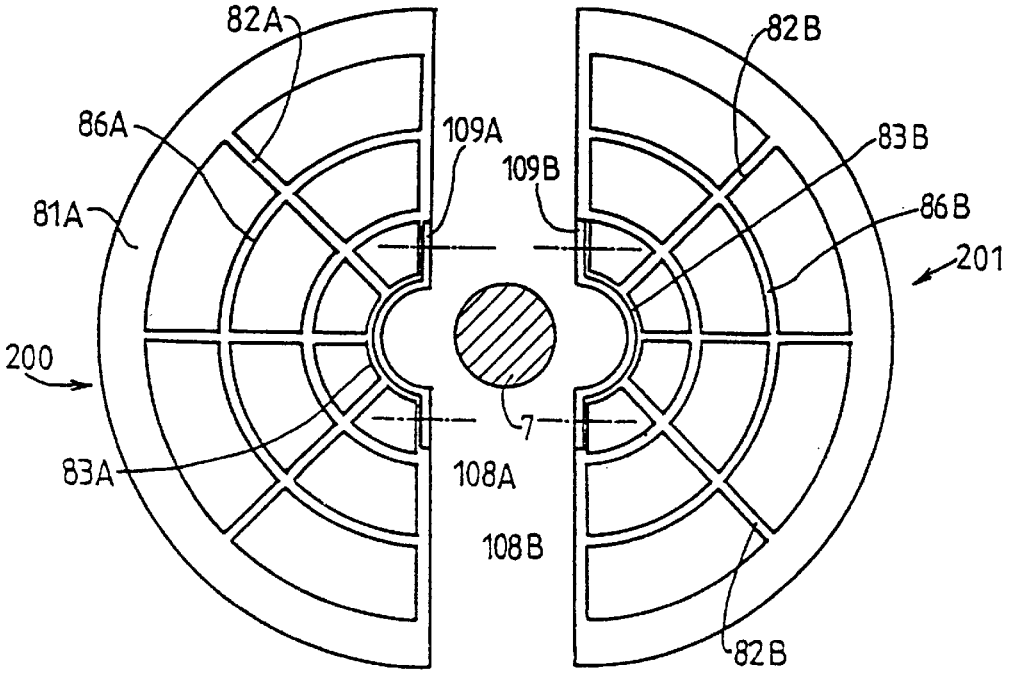
FIG. 9 is a view from above of two support parts in the fitting position.

FIGS. 8 to 10 show another embodiment of a piston support according to the invention. This support consists of two parts 200,201, which for example are absolutely identical, i.e. which correspond substantially to the support in FIG. 1, which is intersected by a diametral plane (which passes through the axis of the rod). These two halves are thus produced from a single mold. These two parts 200, 201 are assembled on the rod 7 by assembly of a collar type. For this purpose, in the upper area and in the lower area of each part, lugs complete the parts in order to form collars.

In greater detail, according to FIG. 8, the left part 200 consists of an outer ring 81A which is connected by radii 82A to a hub 83A or inner ring. In fact in the case of both the ring 81A and the ring 83A, half-rings are involved. The same applies to the intermediate half-rings 86A.

The "right" part 201 comprises the same components as the "left" part 200, with the same references in which the suffix A is replaced by the suffix B.

The half-ring 83A is also longer than the thickness of the radii 82A or of the outer ring 81A, such that the lugs 108A, 109A are accessible for assembly of the two parts 200, 201.

The lower hub 84A also corresponds to a half-hub which is extended on both sides by lugs 110A, 111A which are designed to be assembled, again in the manner of a ring, with the similar lugs 110B, 111B of the lower hub 84B of the other part 201 (FIG. 10).

FIG. 10 also shows the initial parts of the branches 85A and 85B of the two parts 200, 201.

According to FIG. 9, the two parts 200, 201 are disposed on both sides of the rod 7. It is sufficient to assemble them by means of the lugs of the upper collars (which incidentally are partially hidden by the radii 82A, 82B).

The lower collars are also assembled.

This embodiment of the support provides the added advantage of simpler production, since the mold simply corresponds to half the shape of the support. Owing to the symmetry, the same mold can be used to produce the parts 200, 201.

This also considerably facilitates interventions on the pump installed, since it is necessary simply to unscrew and release the support along the rod 7, or to re-engage it along the axis of the rod 7, by means of a connection between two rod components 71. A support can be attached in any position, by means of this assembly by collars. Fitting of the flap valve is just as simple as in the case of the flap valve in FIG. 6. This flap valve is maintained against the upper part of the support by means of an attachment part similar to a collar, which is not shown in the drawings.

Figure 11:
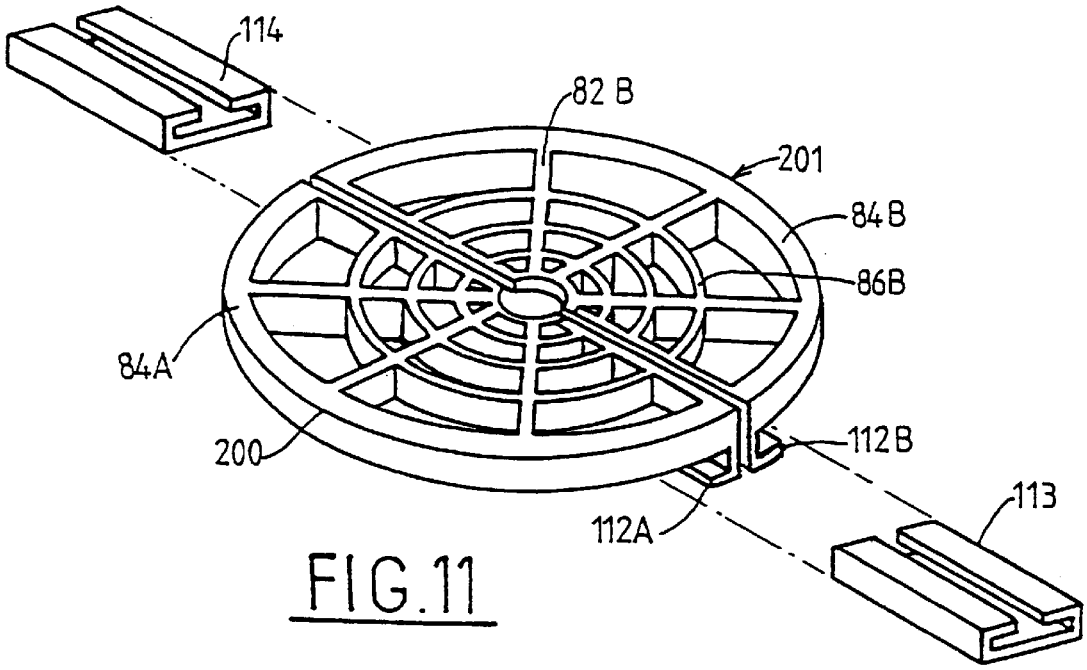
FIG. 11 is a perspective view of another embodiment and method of assembly of a piston, this view being limited to the upper part of the support.

The perspective view in FIG. 11 shows the support which consists of two parts 200, 201 which are similar to the support shown in FIG. 9. For the sake of simplification the legs 85A . . . are not shown in FIG. 11.

These legs are preferably disposed in planes other than the plane of joining of the two halves 200, 201.

On their lower part, along the joining plane, the two parts 200, 201 comprises ribs 112A, 112B on which a clip 113, 114 is engaged. In some cases this method of assembly can be more advantageous for connection of the upper part of the support than a screw connection which is less accessible. On the other hand in their lower area, at the level of the lower hub, the parts 200, 201 can be connected by a screw connection or also by a clip connection such as that which is described here. In this case the ribs can be parallel to the axis of the support, and can slide vertically. In order to prevent the clips from being detached by the effect of vibrations, they can be locked by a small screw.

Figure 12:
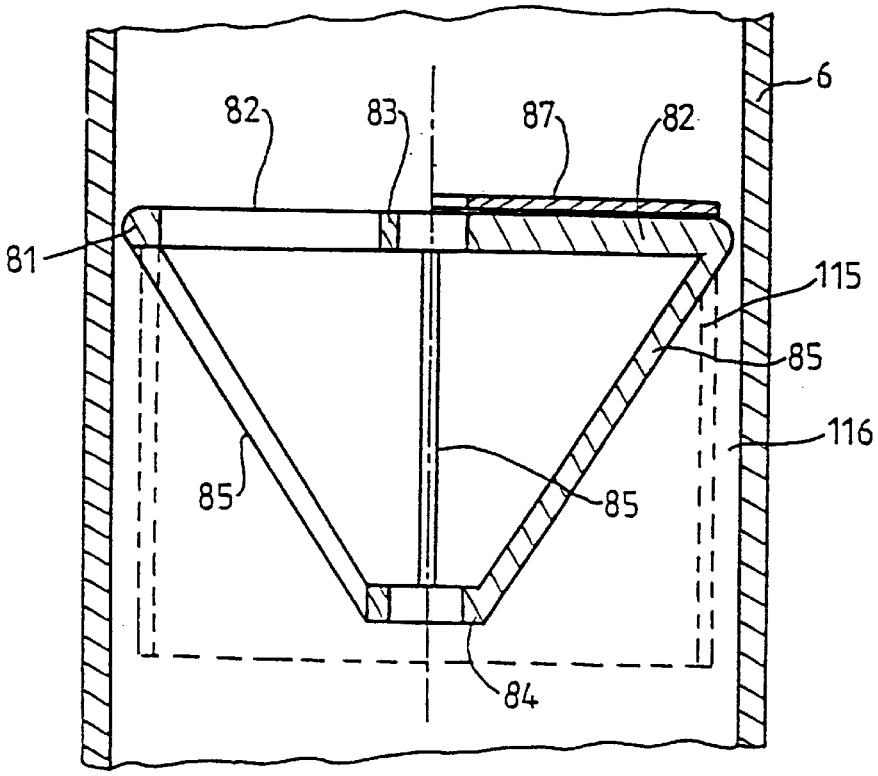
FIG. 12 is a partial cross-sectional view of a piston which is provided with a skirt.

FIG. 12 shows a variant embodiment of the support, for example such as that shown in FIG. 4. This support is completed on its periphery by a skirt 115 which leaves a gap 116 relative to the wall of the raising tube which is sufficient to prevent any friction, whilst nevertheless creating a load loss area in order to slow down the flow of the water which is being pumped. As clearly shown in FIG. 12, this skirt 115 is disposed beneath the support, and not on the side of the flap valve 87.

Another embodiment of a piston according to the invention is described hereinafter by means of FIGS. 13A–15B, 16, which show different variant embodiments of the support and the piston assembly.

Figure 13A:
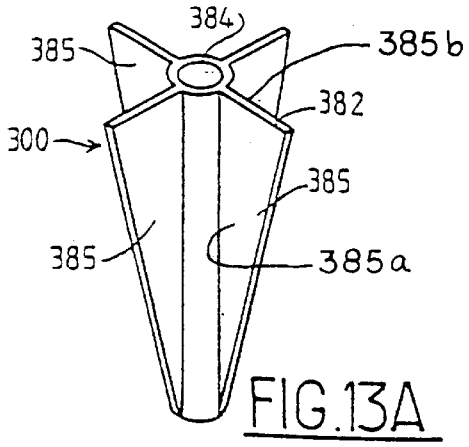
FIGS. 13A–15B are different embodiments of a piston support.

According to FIG. 13A, the support 300 consists of a tubular hub 384, which combines the upper hub and the auxiliary hub of the preceding embodiments.

The legs 385 are constituted by fins with a triangular shape, a first side 385*a* of which is attached to the hub 384, and a second 385*b* side of which constitutes a radius 382 which forms a support surface for the flap valve, which is not shown.

Although the different variants of the support comprise four legs consisting of triangular fins, this number can be different, for example three or five, although an even number is preferable for production because of the plane symmetry which it provides for the support.

Figure 13B:
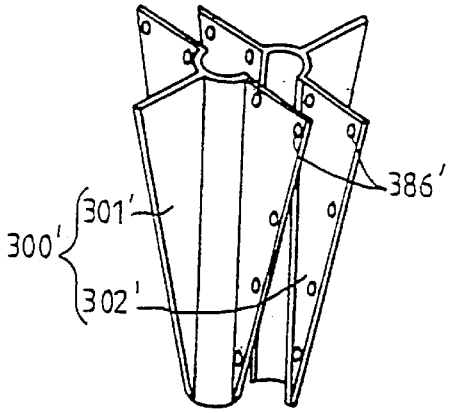

The variant in FIG. 13B corresponds to the form of support in FIG. 13A, except that it is in two symmetrical halves according to a plane which passes through the axis of the rod. These two halves 301', 302' of the support 300' are assembled by their fins which are provided schematically with connection apertures 386'.

Figure 14A:
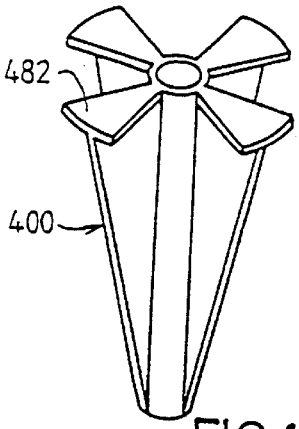
Figure 14B:
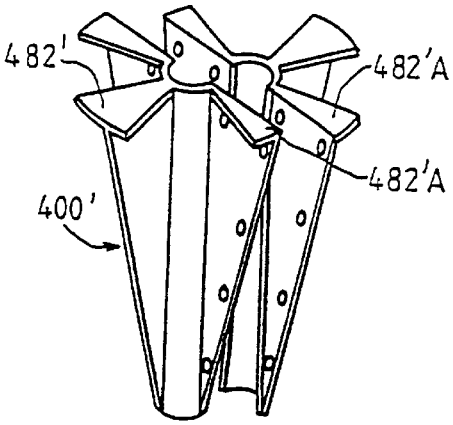

The support variant 400 according to FIG. 14A and its embodiment in two symmetrical parts 400' in FIG. 14B correspond substantially to FIGS. 13A, 13B, except that the radial side of the fins 382 is replaced by a surface 482 which is broader than the thickness of the fins.

In the case of FIG. 14B, for the surfaces which are intersected by the plane of symmetry, the support surfaces 482' are reduced by half, and correspond to the surfaces 482'A.

Figure 15A:
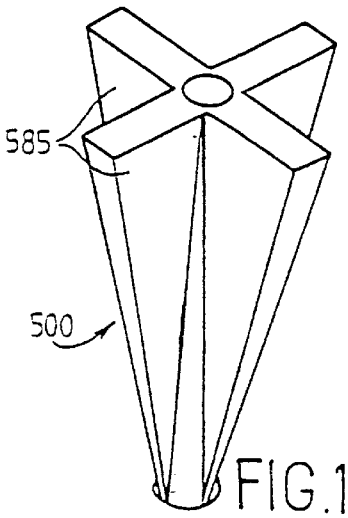
Figure 15B:
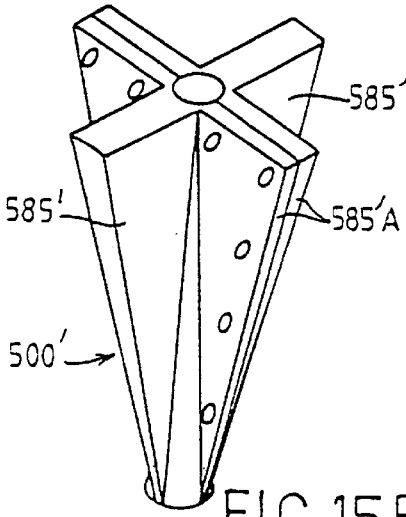

The variant support 500 in FIG. 15A and its embodiment 500' in two symmetrical halves according to FIG. 15B are distinguished from the previous variants by fins 585, 585' which have a thickness which is variable from top to bottom. On the upper part, the fins 585, 585' form a relatively broad support surface, with dimensions which are identical along the entire length. This thickness is reduced towards the base.

In the case of the support 500' in two parts, the fins 585' which are intersected by the plane of symmetry have an overall thickness which is reduced by half.

In the different variants in FIGS. 14A–15B, the description of the parts which are common to those of FIGS. 13A, 13B is not repeated.

Figure 16:
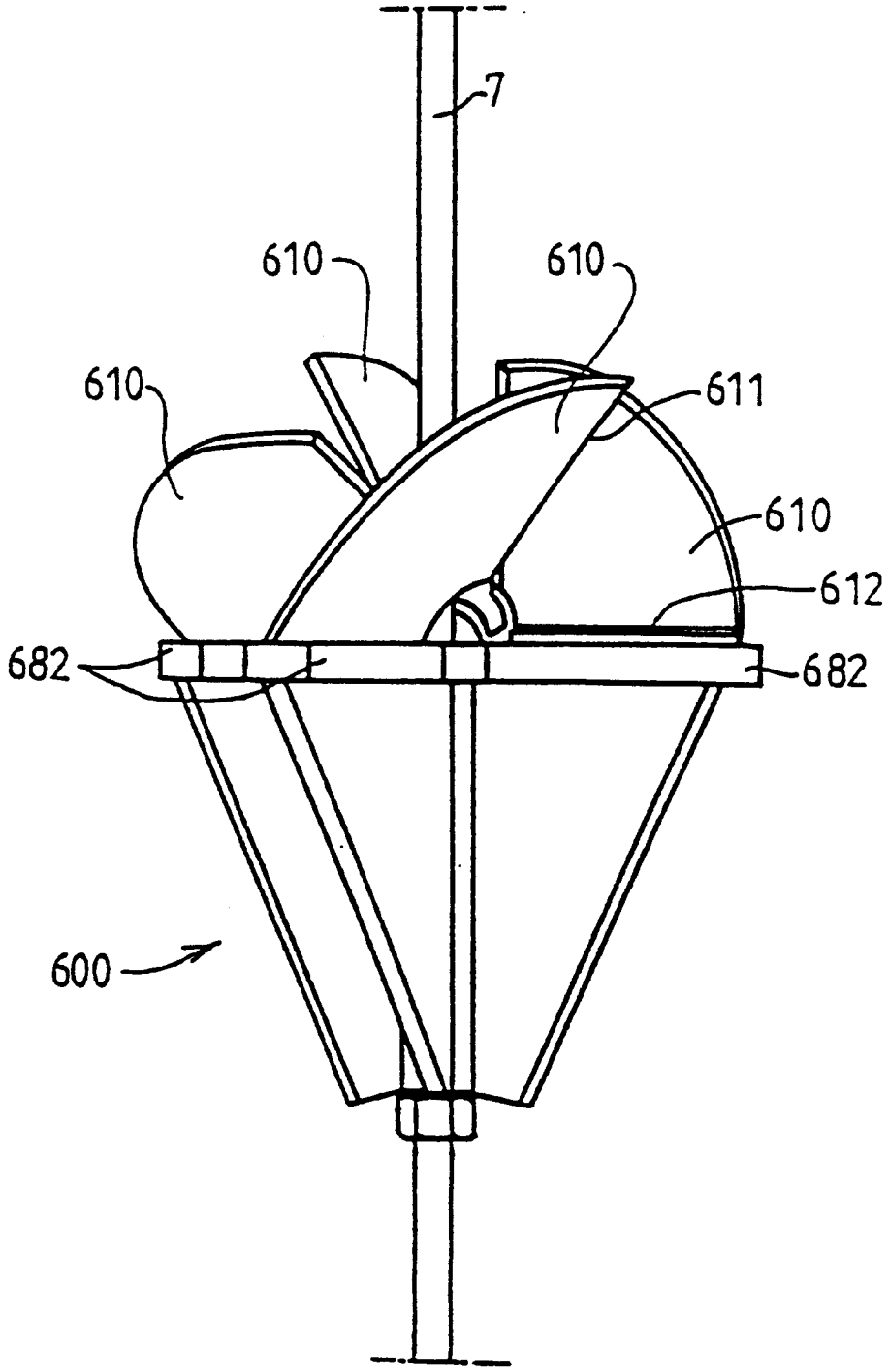
FIG. 16 is a complete piston which is provided with a support according to one of the preceding embodiments.

According to FIG. 16, the piston consists of a support 600 which is constituted by one of the supports of FIGS. 13A–15B and by flap valves 610 which are in the form of disc segments made of a rigid material.

These flap valve segments 610 are articulated on one (611) of their straight sides on the support surface 682 of each fin 685, whereas the other straight side 612 rests freely on the support surface 682 of the following fin (the reference numbers selected for the different parts of the flap valve are the same).

These parts 610 can be pivoted and can for example assume the raised position shown in FIG. 16, in order to descend in the fluid (water).

During the raising movement, the parts of the flap valve 610 are held against the support surfaces 682 of the support.

The movement of raising the parts 610 can be carried out virtually to the vertical position, without going beyond this position, such that the thrust of the water during raising of the piston always holds down each part of the flap valve on the same side.

The direction of opening the parts 610 is preferably the same for all the parts of a single piston. However this direction can be inverted from one piston to another in order to prevention induction of torque in rod 7.

The type of piston according to FIG. 16 is particularly advantageous for descent to great depths, in order to resist efficiently substantial heights of water column.

What is claimed is:

1. A vertical reciprocating pump for raising fluids from a fluid table, comprising:

a pump outlet;

a raising tube interconnecting said pump outlet and the fluid table, said raising tube having two ends;

a base valve on one said end of said raising tube;

a reciprocable rod supporting a piston, said piston comprising:

an upper hub and a lower hub, said lower hub located below said upper hub, an outer ring connected by a plurality of branch members to said upper hub, said upper and lower hubs each connected for reciprocating movement with said rod, said outer ring connected to said lower hub by a plurality of angled leg members, said piston and said raising tube contacting one another at a plurality of points of contact, said points of contact disposed substantially in a plane;

a control connected to said rod for controlling reciprocating movement of said rod; and a piston valve disposed above said outer ring, said branch members and said upper hub.

2. The pump according to claim 1, wherein said valve comprises a diaphragm having an outer edge and an aperture, said aperture being sized to accommodate said rod, said diaphragm being cut between said outer edge and said aperture.

3. The pump according to claim 1, wherein said branch members extend radially from said upper hub to said outer ring.

4. The pump according to claim 1, further comprising:

a plurality of lugs affixed to said upper hub and a plurality of lugs affixed to said lower hub.

5. The pump according to claim 1, wherein said diaphragm comprises a split disc.

6. The pump according to claim 1, wherein said valve comprises a disc shaped diaphragm.

7. The pump according to claim 1, wherein said piston is formed from two, and in particular symmetrical parts, assembled to one another with said rod held there between.

8. A vertical reciprocating pump, comprising:

a pump outlet;

a raising tube interconnecting said pump outlet and a fluid table, said raising tube having two ends;

a base valve on one said end of said raising tube;

a reciprocable rod supporting a piston;

a control connected to said rod for controlling reciprocating movement of said rod;

wherein said piston comprises:

a hub connected for reciprocating movement with said rod;

a plurality of triangular legs, a first side of each of said legs affixed to said hub; and a valve supported by a second side of each of said legs.

9. The pump according to claim 8, wherein a plurality of radial surfaces are affixed to said hub and to said second sides of said legs.

10. The pump according to claim 8, wherein said valve is formed from a plurality of valve segments, each of said valve segments connected to one of said second sides of said legs.

11. A vertical reciprocating pump for raising fluids which are present in the ground, comprising:

a pump outlet;

a raising tube interconnecting said pump outlet and a fluid table, said raising tube having two ends;

a base valve on one said end of said raising tube;

a reciprocable rod supporting a piston;

a control connected to said rod for controlling reciprocating movement of said rod;

wherein said piston comprises:

an outer ring connected by a plurality of branch members to an upper hub, said upper hub connected for reciprocating movement with said rod, wherein all points of contact between said piston and said raising tube lie substantially in a plane; and an intermediate ring connected to said branch members;

a valve disposed above said outer ring, said branch members and said upper hub, wherein said valve comprises a disc shaped diaphragm, and wherein said diaphragm comprises a plurality of overlapping segments having curved lugs sized to fit between said hub and said intermediate ring; and an upper attachment unit locking said segments against said piston.

* * * * *